US006451750B2

(12) United States Patent
Hewitt et al.

(10) Patent No.: US 6,451,750 B2
(45) Date of Patent: Sep. 17, 2002

(54) WATER SOLUBLE PACKAGE AND LIQUID CONTENTS THEREOF

(75) Inventors: Malcolm Hewitt; Hannah Mansfield; Jenny Wiggans, all of Merseyside (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/834,027

(22) Filed: Apr. 12, 2001

(30) Foreign Application Priority Data

Apr. 14, 2000 (GB) ..... 0009340
Dec. 29, 2000 (GB) ..... 0031829

(51) Int. Cl.[7] ..... C11D 1/66; C11D 3/04; C11D 3/30; C11D 17/00

(52) U.S. Cl. ..... 510/297; 510/296; 510/328; 510/330; 510/338; 510/339; 510/341; 510/351; 510/357; 510/499

(58) Field of Search ..... 510/296, 297, 510/328, 330, 338, 339, 341, 351, 357, 499

(56) References Cited

U.S. PATENT DOCUMENTS

| | | | | | |
|---|---|---|---|---|---|
| 4,608,187 | A | * | 8/1986 | Chang | 252/90 |
| 4,610,799 | A | | 9/1986 | Wilsberg et al. | 252/90 |
| 4,747,976 | A | * | 5/1988 | Yang et al. | 252/90 |
| 4,806,261 | A | * | 2/1989 | Ciallella et al. | 252/90 |
| 4,830,652 | A | | 5/1989 | Guenthner | 65/203 |
| 4,846,992 | A | | 7/1989 | Fonsny | 252/90 |
| 4,885,105 | A | * | 12/1989 | Yang et al. | 252/90 |
| 4,886,615 | A | * | 12/1989 | Dehan | 252/90 |
| 4,973,416 | A | | 11/1990 | Kennedy | 252/90 |
| 5,316,688 | A | * | 5/1994 | Gladfelter et al. | 252/90 |
| 5,759,988 | A | * | 6/1998 | Heile et al. | 510/441 |
| 5,820,695 | A | * | 10/1998 | Lance-Gomez et al. | 134/2 |
| 6,211,129 | B1 | * | 4/2001 | Gladfelter et al. | 510/294 |

FOREIGN PATENT DOCUMENTS

| | | | |
|---|---|---|---|
| DE | 3910974 | * | 4/1989 |
| EP | 0 079 712 | | 10/1982 |
| EP | 0 157 162 | | 2/1985 |
| EP | 158 464 | | 3/1985 |
| EP | 160 254 | | 4/1985 |
| EP | 291 198 | | 6/1988 |
| EP | 389 513 | | 11/1988 |
| EP | 518 689 | | 12/1992 |
| EP | 593 952 | | 9/1993 |
| EP | 700 989 | | 9/1994 |
| EP | 941 939 | | 3/1999 |
| FR | 260 19 30 | | 1/1988 |
| FR | 272 43 88 | | 3/1996 |
| GB | 209 06 03 | | 7/1982 |
| GB | 211 89 61 | | 11/1983 |
| GB | 2271574 | * | 4/1994 |
| GB | 230 59 31 | | 4/1997 |
| WO | 96/00251 | | 1/1996 |
| WO | 97/00282 | | 1/1997 |
| WO | 97/27743 | | 8/1997 |
| WO | 00/55044 | | 9/2000 |
| WO | 00/55045 | | 9/2000 |
| WO | 00/55046 | | 9/2000 |
| WO | 00/55068 | | 9/2000 |
| WO | 00/55069 | | 9/2000 |
| WO | 00/55415 | | 9/2000 |

OTHER PUBLICATIONS

F. Schambil and M. Bocker, Tenside Surf. Det. 37 (2000) 1.
Derwent Abstract of DE 298 01 621—published Mar. 19, 1998.
Derwent Abstract of FR 260 19 30—published Jan. 29, 1998.
Derwent Abstract FR 272 43 88—published Mar. 15, 1996.
Co–pending Case: Hewitt et al., S/N 09/834,027; Filed: Apr. 12, 2001.

* cited by examiner

*Primary Examiner*—Gregory Delcotto
(74) *Attorney, Agent, or Firm*—Rimma Mitelman

(57) ABSTRACT

A water soluble package formed from a copolymeric polyvinyl alcohol film, wherein the comonomer comprises a carboxylate function, the package containing a substantially non-aqueous liquid composition which comprises: at least one ionic ingredient with an exchangeable hydrogen ion; and a molar excess (with respect to the amount of exchangeable hydrogen ions in the at least one ionic ingredient) of a stabilizing compound effective for combining with the exchangeable hydrogen ions to hinder the formation of lactones within the film, but can be as low as 95 mole % if the stabilizing compound comprises an inorganic base and/or ammonium hydroxide.

8 Claims, No Drawings

WATER SOLUBLE PACKAGE AND LIQUID CONTENTS THEREOF

TECHNICAL FIELD

The invention relates to a water soluble package for containing a liquid cleaning composition.

BACKGROUND TO THE INVENTION

Water soluble packages are known in the detergent and agrochemical industries and generally comprise either vertical form-fill-seal (VFFS) envelopes or thermoformed envelopes. In one of the VFFS processes, a roll of water soluble film is sealed along its edges to form a tube, which tube is heat sealed intermittently along its length to form individual envelopes which are filled with product and heat sealed. The thermoforming process generally involves molding a first sheet of water soluble film to form one or more recesses adapted to retain a composition, such as for example a solid agrochemical composition, placing the composition in the at least one recess, placing a second sheet of water soluble material over the first so as to cover the or each recess, and heat sealing the first and second sheets together at least around the recesses so as to form one or more water soluble packages.

Cleaning products are traditionally often liquids, viscous or thin, such as known for personal cleaning (bath and shower liquids and shampoos) or for domestic cleaning (hand dish wash and other hard surface cleaning, laundry-cleaning etc.). Other products are solids, such as powders, granules, small capsules (up to 2 mm diameter) or more recently tablets, for laundry and machine dish wash, and soap bars for skin cleaning.

Recently, so called unit dose products are experiencing an increasing success with consumers, because they eliminate the need for manipulating, and possibly spilling, liquids or powders and simplify the use of a correct dose of the cleaning product for the required purpose. Examples thereof are the laundry and machine dish wash tablets mentioned above and recently described in F. Schambil and M. Böcker, Tenside Surf. Det. 37 (2000 ) 1.

PRIOR ART

Many types of water soluble packages are known, including packages made from polyvinyl alcohol (PVOH) film. A wide variety of different materials can be packaged in such films, including liquid materials. EP-A-518689 discloses a containerisation system for hazardous materials (for example pesticides) comprising a PVOH film enclosing a composition comprising the hazardous material, water, an electrolyte and optional other materials. The electrolyte is added to reduce the solubility of the film to prevent its dissolution by the packaged composition.

EP-B-389513 discloses concentrated aqueous syrups (mainly foodstuffs but other materials such as detergents are mentioned) inside PVOH packages, the concentration of the syrup being effective to prevent dissolution of the package by the packaged composition.

EP-A-700989 discloses a unit packaged detergent for dish washing, the package comprising a detergent composition wrapped in PVOH film, wherein the film protects the detergent from dissolution until the main wash cycle of the dish washing machine.

WO-A-97/27743 discloses an agrochemical composition packaged in a water soluble sachet, which can be PVOH.

GB-A-2118961 discloses bath preparations packaged in PVOH film. while EP-B-347221 relates to water-soluble sachets of phytosantary materials which are packaged in a secondary water-insoluble pack with a humid environment being maintained between the two.

EP-A-593952 discloses a water soluble sachet of PVOH with two chambers and a treatment agent for washing inside each chamber.

EP-A-941939 relates to a water soluble package, which can be PVOH, containing a composition which, when dissolved, produces a solution of known composition.

GB-A-2305931 discloses a dissolvable laundry sachet and BE-9700361 relates to a water soluble unit-dosed cleaning agent, especially for cleaning hands.

DE-U-29801621 discloses a water soluble unit dose for dishwashing machines.

EP-B-160254 relates to a washing additive comprising a mixture of detergent constituents in a PVOH bag. The detergent comprises nonionic surfactant and a quaternary ammonium compound.

U.S. Pat. No. 4846992 discloses a double-packaged laundry detergent wherein the inner package is water-soluble and can be PVOH.

EP-8-158464 relates to a detergent mull packaged in PVOH and DE-A-19521140 discloses a water soluble PVOH sachet containing a detergent composition.

FR2601930 relates to a water soluble sachet containing any substance, particularly a pharmaceutical.

A variety of water soluble PVOH films are also known. For example, EP-B-157162 relates to a self-supporting film comprising a PVOH matrix having rubbery microdomains dispersed therein.

WO-A-96/00251 relates to an amphipathic graft copolymer comprising a hydrophobic backbone with grafting sites to which are grafted a hydrophilic polymer prepared from a hydrophilic monomer containing stabilising pH independent ionic groups.

GB-B-2090603 relates to a water soluble film comprising a uniform mixture of partially hydrolysed polyvinyl acetate and polyacrylic acid.

WO-A-97/00282 relates to a water soluble film combining two polymeric ingredients S and H where S is a soft acid-functional olefinic addition copolymer having a Tg less than 20C and H is a hard acid-functional olefinic addition copolymer having a Tg less than 40C. The ratio of S:H is from 90:10 to 65:35 and the acid functionalities are at least partially neutralised to render the film water soluble.

EP-B-79712 relates to a laundry additive for discharge to a wash containing borate ions. The additive is enclosed within a film of PVOH which is plasticised and has as a solubiliser either a polyhydroxy compound (such as sorbitol) or an acid (such as polyacrylic acid).

EP-B-291198 relates to a water soluble film containing an alkaline or borate-containing additive. The film is formed from a copolymer resin of vinyl alcohol having 0–10 mole % residual acetate groups and 1–6 mole % of a non-hydrolysable anionic comonomer. FR2724388 discloses a water soluble bottle, flask or drum made from PVOH which is plasticised with 13–20% of plasticiser (such as glycerol) and then molded.

The specifications of International Patent Applications WO-A-00/55044, WO-A-00/55045, WO-A-00/55046, WO-A-00/55068, WO-A-00155069 and WO-A-00/55415 disclose water soluble packages containing a fluid substance (defined as a liquid, gel or paste) which is a horizontal form-fill-seal (HFFS) envelope. These packages comprise a body wall portion having internal volume and which is preferably dome-shaped, formed from a first sheet, and a superposed base wall portion, formed from a second sheet, seded to the body wall portion.

PVOH can be made by the polymerisation of vinyl acetate, followed by hydrolysis, conveniently by reaction with sodium hydroxide. However, the resulting film has a highly symmetrical, hydrogen-bonded structure and is not readily soluble in cold water. PVOH films which are suitable for the formation of water soluble packages are typically polymers produced from copolymerisation of vinyl acetate and another comonomer which contains a carboxylic function. Examples of such comonomers include monocarboxylates, such as acrylic acid, and dicarboxylates, such as itaconic acid, which may be present during polymerisation as esters. Alternatively, the anhydride of maleic acid may be used as the copolymer. The inclusion of the comonomer reduces the symmetry of and degree of hydrogen bonding in the final film and renders the film soluble even in cold water. However, when the resultant copolymer film contains carboxylic acid or carboxylate groups (either of these hereinafter being referred to as "carboxylate functionality") in proximity to hydroxyl groups on the same carbon chain and there is an attendant drive towards cyclisation of these groups by water elimination to form lactones. A low level of lactone formation is desirable to improve the mechanical properties of the film. However, the formation of excessive amounts of lactones is undesirable as this tends to reduce the cold water solubility of the film, giving rise to a danger of undissolved film residues when the package is used.

The problem of excessive lactone formation is particularly acute when the liquid composition inside the package comprises ionic species. This is thought to be because the presence of ionic species can give rise to exchange between sodium ions (associated with carboxylate groups) in the film and hydrogen ions in the liquid composition. Once such exchange has occurred, the resulting carboxylic acid group in the film can cyclise with a neighboring hydroxyl group, eliminating water in the process, thus forming lactones A polyvinyl alcohol package containing a liquid laundry detergent composition comprising from about 10% to about 24% by weight of water (but 3.57% in the sole example) is disclosed in U.S. Pat. No. 973 416. The polyvinyl alcohol material named in the patent specification was not, at the priority date of that patent, a copolymer having carboxylate functionality.

The problem solved by the present invention is at least partially to overcome the above mentioned problems and provide a water soluble package formed from a copolymeric PVOH film containing a liquid composition which helps to preserve the cold water solubility of the film.

DEFINITION OF THE INVENTION

The present invention provides a water soluble package formed from a copolymeric polyvinyl alcohol film, wherein a comonomer comprises a carboxylate function, the package containing a substantially non-aqueous liquid composition which comprises: at least one ionic ingredient with an exchangeable hydrogen ion; and a molar excess (with respect to the amount of exchangeable hydrogen ions in the at least one ionic ingredient) of a stabilising compound effective for combining with the exchangeable hydrogen ions to hinder the formation of lactones, especially β lactones within the film; with the proviso that if the stabilising compound is or comprises an inorganic base and/or ammonium hydroxide then it is present in an amount of at least 95 mole % of the amount to completely neutralise the at least one ionic ingredient.

DETAILED DESCRIPTION OF THE INVENTION

When the stabilising compound is used with a PVOH comonomer package as described above, it provides an advantage in relation to the avoidance of film residues being left on clothes. By preserving the cold water solubility of the film the invention helps to ensure that even when the package of the invention becomes trapped within the laundry load such that there is only restricted water in contact with the film to dissolve it, dissolution is still sufficiently rapid such that there will be no or minimal residues at the end of the wash cycle.

In one preferred embodiment of the invention the liquid composition is a laundry treatment agent, such as a laundry detergent. In this case the at least one ionic ingredient preferably comprises a fatty acid soap and/or an anionic surfactant acid. The stabilising compound in this case preferably comprises monoethanolamine and/or triethanolamine.

Therefore in one of its aspects the invention provides a liquid laundry treatment agent comprising: one or more ionic ingredients selected from a fatty acid soap and/or an anionic surfactant acid; and a molar excess (with respect to the amount of exchangeable hydrogen ions in the one or more ionic ingredients) of monoethanolamine and/or triethanolamine.

The Substantially Non-Aqueous Liquid Cleaning Composition

The Stabilising Compound

The provision of a molar excess (with respect to the amount of exchangeable hydrogen ions in the at least one ionic ingredient) of the stabilising compound in the liquid composition is found to have a significant effect in maintaining the cold water solubility of the film through the hindrance of lactone formation. However, in the case of inorganic bases and/or ammonium hydroxide forming all or part of the stabilising compound, the amount of stabilising compound need not be in excess, provided it is at least 95 mole % of the amount needed for full neutralisation. Surprisingly, the hindrance of lactone formation is significantly greater when these amounts of stabilising compound is used than when a molar equivalent or less is used. This advantageous effect is particularly marked after prolonged storage (eg for several weeks) of the package according to the invention at elevated temperature (eg 37° C.), conditions which are frequently encountered by some commercial products in European and other markets.

The problem of excessive lactone formation is particularly acute when the liquid composition inside the package comprises ionic species having an exchangeable hydrogen ion, for example fatty acids or the acid precursors of anionic surfactants.

This problem may be solved by including in the composition, a stabilising compound effective for combining with the exchangeable hydrogen ions to hinder the formation of lactones within the film. This stabilising compound should preferably be in molar excess relative to the component(s) having an exchangeable ion. This molar excess is preferably up to 105 mole %, preferably up to 110 mole % of the stoichiometric amount necessary for complete neutralisation. It is preferably an organic base such as one or more amines, e.g. monoethanolamine, triethanolamine and mixtures thereof. When the stabilising compound is or comprises an inorganic base such as an alkali metal (e.g. sodium or potassium) hydroxide, or ammonium hydroxide, it may, however, present in an amount as low as 95 mole %, eg. from 95 mole % to 105 mole % relative to the component (s) having an exchangeable hydrogen ion.

In other aspects of the invention, for the stabilising compound, instead of the 95 mole %, we may claim as minimum, any of 90, 91, 92, 93, 94, 94.4, 96, 96.5, 97, 97.5, 98, 98.5, 99 and 99.5 mole %. Also, independently of any particular minimum, in other aspects of the invention, as maximum, we may claim any of 100.25, 100.5, 101, 101.5, 102, 102.5, 103, 103.5, 104, 105, 106, 107, 108, 109 and 110 mole %.

Other possible inorganic stabilising compounds are alkaline earth metal hydroxides or other inorganic bases which do liberate water on protonation. These are preferably also used in an amount indicated above for the alkali metal hydroxides and ammonium hydroxide.

Yet other suitable stabilising compounds are amines other than monoethanolamine and triethanolamine, and organic Lewis bases or other organic or inorganic bases provided that they will interact effectively with labile protons within the detergent composition to hinder the production of lactones in the film.

Non-Aqueous Liquid Component

The substantially non-aqueous liquid cleaning composition must contain at least one non-aqueous liquid. Further, the non-aqueous liquid itself and/or another component of the composition must provide a cleaning function when released into the wash liquor.

By "substantially non-aqueous" it is meant that that the amount of water in the liquid composition is below the level at which the package would dissolve through contact with its contents. Preferably, the liquid composition comprises 25%, e.g. no more than 20%, more preferably no more than about 15%, still more preferably no more from 10%, such as no more than about 7%, even more preferably no more than about 5% and most preferably no more than from about 3% to about 4%, by weight water. However, in some cases, it may be possible (whether by reason of the thickness of the film used, the physical properties, such as viscosity, of the liquid composition or otherwise) to use even higher quantities of water in the liquid composition inside the package according to the invention, although these should never exceed 50% by weight of the liquid composition.

The substantially non-aqueous liquid composition may be substantially Newtonion or else non-Newtonion in rheology. The latter especially applies when the composition comprises dispersed solids. Therefore, for the avoidance of doubt, all viscosities expressed herein are measured at a shear rate of $21s^{-1}$.

The viscosity of the composition is preferably from 25 mPaS, 50 mPaS, 75 mPaS or 100 mPaS, preferably 125 mPaS, more preferably 150 mPaS to 10,000 mPaS, for example above 150 mPaS but no more than 10,000 mPaS. The alternative embodiment of the invention relates to VFFS encapsulation in which case, the minimum viscosity must be 150 mPaS, for example above 150 mPaS.

The composition may be considered as falling into the sub-classes of thin liquids, thick liquids, and gels/pastes.

The thin liquids may have a minimum viscosity of 25, 50, 75, 100, 125, 150 mPaS or above 150 mPaS for example 175 mPaS, preferably 200 mPaS. They may for example have a maximum viscosity of 500 mPaS preferably 450 mPaS more preferably 400 mPaS or even 250 mPaS.

The thick liquids may have a minimum viscosity of 400 mPaS, for example 350 mPaS, or even 300 mPaS and a maximum viscosity of 1,500 mPaS, preferably 1,200 mPaS.

The gels or pastes may have a minimum viscosity of 1,400 mPaS, for example 1,500 mPaS, preferably 1,750 mPaS, 2000 mPaS, 2,500 mPaS, 3,000 mPaS or even 3,500 mPaS. Their maximum viscosity may be 10,000 mPaS, preferably 9,000 mPaS, more preferably 8,000 mPaS, 7,500 mPaS or even 4,000 mPaS.

The non-aqueous liquid may comprise one or more non-aqueous liquid components. These may be one or more liquid surfactants and/or one or more non-aqueous non-surfactant liquids.

Suitable liquid surfactants liquid nonionic surfactants.

Nonionic detergent surfactants are well-known in the art. They normally consist of a water-solubilizing polyalkoxylene or a mono- or d-alkanolamide group in chemical combination with an organic hydrophobic group derived, for example, from alkylphenols in which the alkyl group contains from about 6 to about 12 carbon atoms, dialkylphenols in which primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylense. Also common are fatty acid mono- and dialkanolamides in which the alkyl group of the fatty acidradical contains from 10 to about 20 carbon atoms and the alkyloyl group having from 1 to 3 carbon atoms. In any of the mono- and di-alkanolamide derivatives, optionally, there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in the applicants' published European specification EP-A-225, 654, especially for use as all or part of the solvent. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 or 7 moles of ethylene oxide. These may be used as the sole nonionic surfactants or in combination with those of the described in the last-mentioned European specification, especially as all or part of the solvent.

Another class of suitable nonionics comprise the alkyl polysaccharides (polyglycosides/oligosaccharides) such as described in any of specifications U.S. Pat. Nos. 3,640,998; 3,346,558; 4,223,129; EP-A-92,355; EP-A-99,183; EP 70,074, '75, '76, '77; EP 75,994, '95, '96.

Nonionic detergent surfactants normally have molecular weights of from about 300 to about 11,000. Mixtures of different nonionic detergent surfactants may also be used, provided the mixture is liquid at room temperature.

Suitable non-aqueous non-surfactant liquids forms can be used alone or with in combination with liquid surfactants. Non-surfactant solvents which are more preferred category include ethers, polyethers, alkylamines and fatty amines, (especially di- and tri-alkyl- and/or fatty-N-substituted amines), alkyl (or fatty) amides and mono- and di- N-alkyl substituted derivatives thereof, alkyl (or fatty) carboxylic acid lower alkyl esters, ketones, aldehydes, polyols, and glycerides. Specific examples include respectively, di-alkyl ethers, polyethylene glycols, alkyl ketones (such as acetone) and glyceryl trialkylcarboxylates (such as glyceryl triacetate), glycerol, propylene glycol, and sorbitol.

Other suitable solvents are lower ($C_{1-4}$) alcohols, such as ethanol, or higher ($C_{5-9}$) alcohols, such as hexanol, as well as alkanes and olefins. However, they can be combined with other solvent materials which are surfactants and non-surfactants having the aforementioned "preferred" kinds of molecular structure. Even though they appear not to play a role in the deflocculation process, it is often desirable to include them for lowering the viscosity of the product and/or assisting soil removal during cleaning.

Preferably, the compositions of the invention contain the organic solvent (whether or not comprising liquid surfactant) in an amount of at least 10% by weight of the total composition. The amount of the solvent present in the composition may be as high as about 90%, but in most cases the practical amount will lie between 20 and 70% and sometimes, between 20 and 50% by weight of the composition. The weight ratio of surfactant to non-surfactant non-aqueous liquid components is preferably from 0:10 to 10:0, more preferably from 1:10 to 10:1, still more preferably from 1:6 to 6:1, yet more preferably from 1:5 to 5:1, eg. from 1:3 to 3:1.

Whether or not the composition contains nonionic surfactant, one or more other surfactants may be present. These may be in liquid form or as solid dissolved or dispersed in the substantially non-aqueous liquid component. They may be selected from anionic cationic and ampholytic detergent surfactants. The anionic surfactants may be incorporated in free acid and/or neutralised form. The cationic surfactant may be neutralised with a counter ion or it may be used as stabilising compound to neutralise the at least one ionic ingredient with an exchangeable hydrogen ion.

The composition may also comprise one or more solid dissolved and/or dispersed in the substantially non-aqueous liquid. When these are dispersed solids, it is preferred also to include one or more deflocculating agents as described in EP-A-0 266 199.

Some of these ingredients may be of an acidic nature, such as soaps or the acid precursors of anionic surfactants (which can be used for their surfactant properties and/or as deflocculants). These materials have an exchangeable hydrogen ion.

The Ionic Ingredient with Exchangeable Hydrogen Ions

When present, the ionic ingredient with exchangeable hydrogen ions may, for example, constitute from between 1% and 40% (prior to any neutralisation) by weight of the total substantially non-aqueous liquid composition. When used primarily for their surfactant properties, such ingredients may for example be present in amounts greater than 10% by weight. When used as deflocculants (see below), the amounts may be 10% by weight or less, e.g. no more than 5% by weight. These ingredients may for example be selected from anionic surfactant acid precursors and fatty acids and mixtures thereof.

Anionic surfactant acids are well known to those skilled in the art. Examples suitable for use in a liquid composition according to the invention include alkylbenzene sulphonic acid, particularly $C_{8-15}$ linear alkylbenzene sulphonic acids and mixtures thereof. Other suitable surfactant acids include the acid forms of olefin sulphonates, alkyl ether sulphates, alkyl sulphates or alkane sulphonates and mixtures thereof.

A wide range of fatty acids are suitable for inclusion in a liquid composition according to the invention, for example selected from one or more $C_{8-24}$ alkyl or alkenyl monocarboxylic acids. Saturated or unsaturated fatty acids may be used. Examples of suitable fatty acids include oleic acid, lauric acid or hardened tallow fatty acid.

Other Components

The substantially non-aqueous liquid cleaning composition may further comprise one or more ingredients selected from non-ionic or cationic surfactants, builders, polymers, fluorescers, enzymes, silicone foam control agents, perfumes, dyes, bleaches and preservatives.

Some of these materials will be solids which are insoluble in the substantially non-aqueous liquid medium. In that case, they will be dispersed in the substantially non-aqueous liquid medium and may be deflocculated by means of one or more acidic components such as selected from inorganic acids anionic surfactant acid precursors and Lewis acids, as disclosed in EP-A-266 199, as mentioned above.

The Water Soluble Package

Any reference herein to filling refers to complete filling and also partial filling whereby some air or other gas is also trapped in the sealed envelope.

The envelope forming the package is preferably formed by horizontal or vertical form-film-seal technique.

(a) The Copolymer Film

A preferred plastics film is a polyvinyl alcohol film, especially one made of a polyvinyl alcohol copolymer having a comonomer having a carboxylate function.

PVOH can be made by the polymerisation of vinyl acetate, followed by hydrolysis, conveniently by reaction with sodium hydroxide. However, the resulting film has a highly symmetrical, hydrogen-bonded structure and is not readily soluble in cold water. PVOH films which are suitable for the formation of water soluble packages are typically polymers produced from copolymerisation of vinyl acetate and another comonomer which contains a carboxylic function. Examples of such comonomers include monocarboxylates, such as acrylic acid, and dicarboxylates, such as itaconic acid, which may be present during polymerisation as esters. Alternatively, the anhydride of maleic acid may be used as the copolymer. The inclusion of the comonomer reduces the symmetry of and degree of hydrogen bonding in the final film and renders the film soluble even in cold water. Suitable PVOH films for use in a package according to the invention are commercially available and described, for example, in EP-B-0291198. PVOH films for use in a package according to the invention can be made by the copolymerisation of vinyl acetate and a carboxylate-containing monomer (for example acrylic, maleic or itaconic acid or acid ester), followed by partial (for example up to about 90%) hydrolysis with sodium hydroxide.

(b) Horizontal form-fill-seal

Water soluble PVOH packages of the invention can be made according to any of the methods horizontal form-fill-seal described in any of WO-A-00/55044, WO-A-00/55045, WO-A-00/55046, WO-A-00/55068, WO-A-00/55069 and WO-A-00155415.

By way of example, a thermoforming process is now described where a number of packages according to the invention are produced from two sheets of water soluble material. In this regard recesses are formed in the film sheet using a forming die having a plurality of cavities with dimensions corresponding generally to the dimensions of the packages to be produced. Further, a single heating plate is used for thermoforming the film for all the cavities, and in the same way a single sealing plate is described.

A first sheet of polyvinyl alcohol film is drawn over a forming die so that the film is placed over the plurality of forming cavities in the die. In this example each cavity is generally dome shape having a round edge, the edges of the cavities further being radiussed to remove any sharp edges which might damage the film during the forming or sealing steps of the process. Each cavity further includes a raised surrounding flange. In order to maximise package strength; the film is delivered to the forming die in a crease free form and with minimum tension. In the forming step, the film is heated to 100 to 120° C., preferably approximately 11 0C, for up to 5 seconds, preferably approximately 700 micro seconds. A heating plate is used to heat the film, which plate is positioned to superpose the forming die. During this preheating step, a vacuum of 0.5 bar is pulled through the pre-heating plate to ensure intimate contact between the film and the pre-heating plate, this intimate contact ensuring that the film is heated evenly and uniformly (the extent of the vacuum is dependant of the thermoforming conditions and the type of film used, however in the present context a vacuum of less than 0.6 bar was found to be suitable) Non-uniform heating results in a formed package having weak spots. In addition to the vacuum, it is possible to blow air against the film to force it into intimate contact with the preheating plate.

The thermoformed film is molded into the cavities blowing the film off the heating plate and/or by sucking the film into the cavities thus forming a plurality of recesses in the film which, once formed, are retained in their thermoformed orientation by the application of a vacuum through the walls of the cavities. This vacuum is maintained at least until the packages are sealed. Once the recesses are formed and held in position by the vacuum, a liquid composition according to the invention is added to each of the recesses. A second sheet of polyvinyl alcohol film is then superposed on the first sheet across the filled recesses and heat-sealed thereto using a sealing plate. In this case the heat sealing plate, which is generally flat, operates at a temperature of about 140 to 160° C., and contacts the films for 1 to 2 seconds and with a force of 8 to 30kg/cm$^2$, preferably 10 to 20 kg/cm$^2$. The raised flanges surrounding each cavity ensure that the films are sealed together along the flange to form a continuous seal. The radiussed edge of each cavity is at least partly formed by a resiliently deformable material, such as for example silicone rubber. This results in reduced force being applied at the inner edge of the sealing flange to avoid heat/pressure damage to the film.

Once sealed, the packages formed are separated from the web of sheet film using cutting means. At this stage it is possible to release the vacuum on the die, and eject the formed packages from the forming die. In this way the packages are formed, filled and sealed while nesting in the forming die. In addition they may be cut while in the forming die as well.

During the forming, filling and sealing steps of the process, the relative humidity of the atmosphere is controlled to ca. 50% humidity. This is done to maintain the heat sealing characteristics of the film. When handling thinner films, it may be necessary to reduce the relative humidity to ensure that the films have a relatively low degree of plasticisation and are therefore stiffer and easier to handle.

(c) Vertical Form-Fill-Seal

In the vertical form-fill-seal (VFFS) technique, a continuous tube of flexible plastics film is extruded. It is sealed, preferably by heat or ultrasonic sealing, at the bottom, filled with the liquid composition, sealed again above the liquid film and then removed from the continuous tube, e.g. by cutting.

Unit Dose Volume

The amount of the substantially non-aqueous liquid cleaning composition is each unit dose envelope may for example be from 10 ml to 100 ml, e.g. from 12.5 ml to 75 ml, preferably from 15 ml to 60 ml, more preferably from 20 ml to 55 ml.

The invention will now be more particularly described with reference to the following examples.

EXAMPLES

Example 1

A liquid detergent composition according to the invention was prepared as follows. The following ingredients were taken:

TABLE 1

| | |
|---|---|
| Nonionic (Neodol C11. 5EO) | 26% |
| LAS acid | 20% |
| Priolene 6907 fatty acid | 13% |
| Glycerol | 20% |
| Water | 4% |
| Perfume | 1% |
| Enzymes + polymer | 2% |
| Monopropylene glycol | 7% |
| Monoethanolamine | calculated - see table |

The appropriate level of monoethanolamine was calculated with reference to the LAS and fatty acid quantities and acid values to give different levels of molar equivalence or excess of monoethanolamine with respect to the amount of exchangeable hydrogen ions in the liquid composition.

The liquid compositions according to the invention were prepared by adding the monoethanolamine to the surfactant mixture in the monopropylene glycol/glycerol solvent system. The surfactant mixture consisted of Neodol C11-5EO alkyl ethoxylates, alkyl benzene sulphonic (LAS) acid and Priolene 6907 (a commercial C16–18 fatty acid mixture. The solvent system consisted of monopropylene glycol, glycerol and water. Subsequently, minor ingredients, such as perfume and enzymes were added.

The exact molar equivalent of monoethanolamine required to balance the exchangeable hydrogen ions from the surfactant mixture was calculated from the total acidity of the sample. Different monoethanolamine levels were calculated and samples prepared according to those levels from 100% to 110% molar equivalence of monoethanolamine with respect to exchangeable hydrogen ions. 25 ml capacity packages containing these liquid compositions were fabricated according to the procedure outlined above. The PVOH film used was a commercial material available from Chris Craft Industries under reference Monosol M8534.

These packages were stored at 37° C. and 70% relative humidity for 8 and 13 weeks. At the end of these periods, the capsules were either tested for solubility as described below or a small film sample was cut from a capsule, blotted to remove excess liquid and then measured to ascertain the ratio of lactone: free carboxylate peaks using the Biorad FTS60A with Fourier Transform Infra Red over the absorption range 4000–650 cm-1

To test the packages according to the invention for cold water solubility and residue deposition each package was placed within an open mesh net in a beaker containing 5 liters of water at 30° C. The water inside the beaker was then agitated with a magnetic stirrer for about 5 minutes. The amount of residue left inside the net was assessed by comparison against prepared standards from the same test.

This test does not accurately simulate washing machine behaviour but provides a ranking method whereby residue levels of 40% or below equate to very few consumer complaints in field.

| Storage at 37° C. and 70% RH | Monoethanolamine level (mole equivalence w.r.t. $H^+$) | Lactone/ $COO^-$ ratio (by FTIR) | % Residue (in net) |
|---|---|---|---|
| 8 weeks | 1.00 | 1.62 | ~95 |
| 8 weeks | 1.05 | 1.03 | 50–60 |
| 8 weeks | 1.10 | 0.62 | 40 |
| 13 weeks | 1.00 | 1.85 | 85–90 |
| 13 weeks | 1.05 | 0.99 | 80 |
| 13 weeks | 1.10 | 0.61 | 40 |

These results demonstrate that residues left in the net are reduced for a molar excess of monoethanolamine as compared to a molar equivalence of monoethanolamine and are further reduced when the molar excess is 0.1 as compared to 0.05.

Example 2

The experiment of Example 1 was repeated using potassium hydroxide in place of monoethanolamide.

The results demonstrated that residues left in the net ar reduced for amounts of the potassium hydroxide within the range of 0.95 to 1.02 times the stoichiometric amount necessary for complete neutralisation of the acidic components. Below that range, the residues were significantly increased. Above that amount, the solubility of the product was degraded.

What is claimed is:

1. A water soluble package formed from a copolymeric polyvinyl alcohol film, wherein a comonomer comprises a carboxylate function, the package containing a substantially non-aqueous liquid composition which comprises at least one ionic ingredient with an exchangeable hydrogen ion, no more than about 5% by weight of water and a molar excess, with respect to the amount of exchangeable hydrogen ions in the at least on ionic ingredient, of a stabilizing compound selected from the group consisting of monoethanolamine, triethanolamine, potassium hydroxide, and mixtures thereof, effective for combining with the exchangeable hydrogen ions to hinder the formation of lactones with the film;

with the proviso that if the stabilizing compound is or comprises an inorganic base or ammonium hydroxide then it is present in an amount of at least 95 mole % of the amount to completely neutralise the at least one ionic ingredient.

2. A water soluble package according to claim 1, wherein the molar excess of stabilising compound is at least 105 mole %.

3. A water soluble package according to claim 1, wherein the molar excess of stabilising compound is at least 110 mole %.

4. A water soluble package according to claim 1, wherein on protonation the stabilising compound forms a salt which is liquid at room temperature and pressure or which forms a liquid in combination with the liquid composition inside the package under those conditions.

5. A water soluble package according to claim 1, wherein the liquid composition is a laundry treatment agent.

6. A water soluble package according to claim 5, wherein the at least one ionic ingredient comprises a fatty acid soap.

7. A water soluble package according to claim 5, wherein the at least one ionic ingredient comprises an anionic surfactant acid.

8. A water soluble package according to claim 1, wherein the substantially non-aqueous liquid cleaning composition comprises cationic surfactant.

* * * * *